US010173335B2

(12) United States Patent
Oven et al.

(10) Patent No.: US 10,173,335 B2
(45) Date of Patent: Jan. 8, 2019

(54) LEVEL CUTTING DEVICE

(71) Applicants: Fredric A. Oven, Derry, NH (US); Atara M. Oven, Derry, NH (US)

(72) Inventors: Fredric A. Oven, Derry, NH (US); Atara M. Oven, Derry, NH (US)

( * ) Notice: Subject to any disclaimer, the term of this patent is extended or adjusted under 35 U.S.C. 154(b) by 33 days.

(21) Appl. No.: 15/072,752

(22) Filed: Mar. 17, 2016

(65) Prior Publication Data

US 2017/0266829 A1 Sep. 21, 2017

(51) Int. Cl.
*B26D 1/02* (2006.01)
*B26D 7/26* (2006.01)

(52) U.S. Cl.
CPC ..... *B26D 1/025* (2013.01); *B26D 7/2628* (2013.01)

(58) Field of Classification Search
CPC ..... B26D 1/025; B26D 7/2628; B26D 3/11; B26B 29/06; B26B 5/00; B26B 5/006
USPC ..... 264/138, 142, 141, 145, 36.1, 146
See application file for complete search history.

(56) References Cited

U.S. PATENT DOCUMENTS

| | | | | |
|---|---|---|---|---|
| 4,545,515 | A | 10/1985 | Kozyrski | |
| 4,622,743 | A | 11/1986 | Voegele | |
| 4,960,022 | A | 10/1990 | Chuang | |
| 5,339,530 | A | 8/1994 | Wright | |
| 5,579,673 | A | 12/1996 | Howarth | |
| 5,740,614 | A * | 4/1998 | Carder | B26B 5/005 30/287 |
| 5,848,471 | A * | 12/1998 | Freeland | B26D 3/003 30/280 |
| 6,200,065 | B1 | 3/2001 | Eitzen | |
| 7,357,596 | B2 | 4/2008 | Face, III et al. | |
| 2001/0034946 | A1 | 11/2001 | Hamdorf | |
| 2004/0227022 | A1 * | 11/2004 | Friedenbach | B26B 5/00 241/30 |
| 2006/0179664 | A1 * | 8/2006 | Butler | B26D 3/28 30/294 |
| 2012/0291604 | A1 | 11/2012 | Kozyrski | |

FOREIGN PATENT DOCUMENTS

| | | |
|---|---|---|
| CN | 202462458 | 10/2012 |
| WO | 2015136566 | 9/2015 |

* cited by examiner

*Primary Examiner* — Stephen Choi
*Assistant Examiner* — Liang Dong
(74) *Attorney, Agent, or Firm* — Lambert Shortell & Connaughton; Gary E. Lambert; David J. Connaughton, Jr.

(57) ABSTRACT

A cutting device is provided. The cutting device has a body which forms the structure of the device. A slot is formed by the body along the length of its bottom face. The slot is inset as a channel along the length of the bottom face, extending from front to back of the body. A cutting blade spans the channel at a distance above the bottom face and below a top of the channel. In a method of use, a material may be positioned in the slot, and the body may be drawn across the material (or material drawn through slot). The blade may then cut the material as it passes through the channel.

6 Claims, 2 Drawing Sheets

LEVEL CUTTING DEVICE

BACKGROUND OF THE INVENTION

Field of the Invention

The present invention relates generally to cutting. More particularly the present invention relates to a cutting device for plastic stripping that provides a level cut relative to a height of the strip.

Description of Related Art

When constructing interior elements that require careful and thorough sealing, measurement to precise tolerances is vital. For example, when constructing a shower door assembly, it is necessary that a plastic sealant strip be the right size. Too small and there will be a gap between door, sides, and bottom. Too large, and the shower door will not close properly, which also causes a gap. Through these gaps, water can leak, causing damage, mold, and the like. Adding to this difficulty is that practically, when constructing shower assemblies, no two are the same, and each will inevitably require a slightly differently sized sealant strip.

Therefore, what is needed is a device that may cut elongate material, such as plastic shower seal strips, to an even and precise height.

SUMMARY OF THE INVENTION

The subject matter of this application may involve, in some cases, interrelated products, alternative solutions to a particular problem, and/or a plurality of different uses of a single system or article.

In one aspect, a cutting device is provided. The cutting device has a body which forms the structure of the device. A slot is formed by the body along the length of its bottom face. The slot is inset as a channel along the length of the bottom face, extending from front to back of the body forming an open front and rear to the channel. A cutting blade spans the channel at a distance above the bottom face and below a top of the channel. The cutting blade may be permanently affixed or removable from the channel. In one aspect, an opening is defined by a side of the body providing access to the slot. The cutting blade may pass through this opening to access the slot. In an embodiment of use, a material may be positioned in the slot, and the body may be drawn across the material (or material drawn through slot). The blade may then cut the material as it passes.

DETAILED DESCRIPTION

Figure 1:
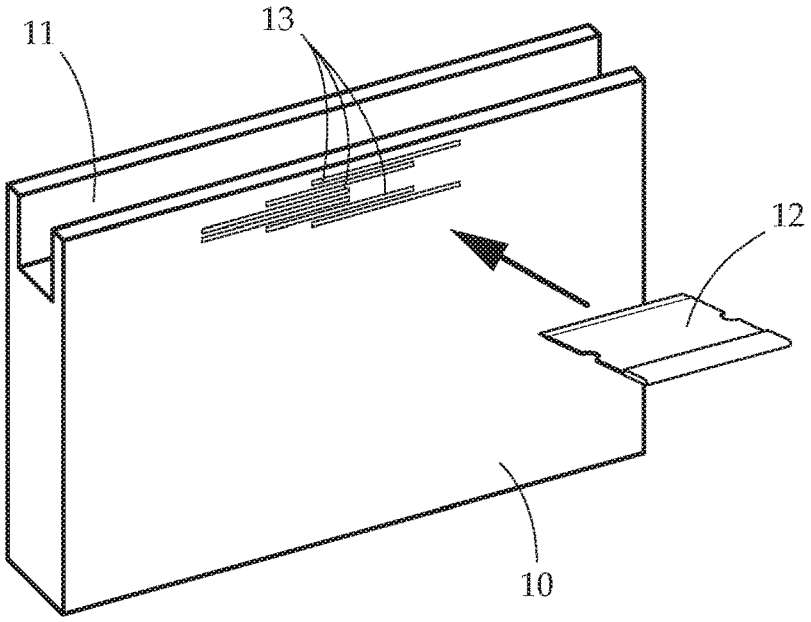
FIG. 1 provides a perspective view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a level cutting device. The device comprises a body having a straight and flat bottom face, a slot is recessed into this flat bottom edge along the entire length of the body. An elongate piece plastic stripping (or other material) may fit within this slot and may slide through it. In one embodiment, one or a plurality of thin openings may be formed along the length of the body in a side, such that the openings provide communication to the slot. This opening or openings may be sized such that a blade (such as a razor blade and the like) can be placed in the opening, spanning the slot. As positioned, any plastic strip, or other material passing through the slot will be cut at the height of the blade. Because of the even and flat bottom face, the device can be placed flat, and during cutting, an even and continuous height will be ensured so long as the bottom face remains in place on a continuous surface.

The present invention may be used to cut any material having an elongate shape that is sized to fit within the cutting slot. Typically however, elongate strips may be cut. This material may hereinafter be referred to as a "plastic strip," though it is to be understood that any material may be cut without straying from the scope of the present invention. More typically, plastic elongate strips having extension, lips, edges, flanges, and the like along their length can be cut easily and effectively with the present invention. Specific examples of items to be cut with the present cutting device include plastic shower door strips, and plastic strips having lipped or flanged protrusions along their length.

Even cutting of a height of a plastic shower door strip may be particularly important because of the need to have very precise sizing. As such, even small variations in height can render the product useless for sealing a shower door. Accordingly, the present invention allows a user to cut the shower door strip to a completely straight and even height for optimal installation and sealing.

The body of the cutting device may be made of any material resilient and rigid enough to support a cutting blade in the slot that may be handled by a person during the cutting. Examples of which the body of the cutting device may be made include, but are not limited to: metals, plastics, composite materials, wood, ceramics, and the like.

The blade of the cutting device similarly may be made of any material capable of cutting the plastic strips intended to be cut by the device. Examples of which the blade of the cutting device may be made include, but are not limited to: metals, plastics, ceramics, and the like.

The blade may be positioned within the slot in a number of different manners, and may be removable or permanently attached to the slot walls (optionally omitting the body side openings to provide access to the slot). In one embodiment, the opening may be sized to receive a standard sized razor blade. In this embodiment, a user may buy razor blades such as a flat razor or box cutting razor at a store, and may use it by passing the razor through the opening in the body. In another embodiment, the razor may be pivotably attached to the body (by, for example, a hinge) such that it can be urged into and out of an opening when cutting or not cutting. In such embodiments, the razor may also be lockable in place when pivoted into position. In yet another embodiment, a blade may be built into the body and permanently attached therein by connection to one or both walls of the slot. In one embodiment, the blade may be angled downwardly towards the body bottom edge so as to resist an upward lifting of the body during cutting.

In some embodiments, a handle may extend from the body to provide a more ergonomic hand holding area and to provide a user with a better gripping surface. The handle may be of any shape and size to accommodate holding, such as a bar, protrusion, depression, and the like. Further, it should be understood that aside from the flat bottom face and slot, the body may have any shape and sizing without straying from the scope of the present invention.

Turning now to FIG. 1, a perspective view of an embodiment of the present invention is provided. In this view, the bottom flat face of the body 10 is shown facing upward. A slot 11 is defined along part of a width and the entire length of a bottom face of body 10. While the slot 11 is shown herein as having a rectangular cross section, it should be understood that any shape and cross sectional orientation may be used, so long as the intended elongate plastic strip portion to be cut can fit within the slot. In the embodiment shown, six openings 13 are formed at varying heights along a side of body 10. These openings 13 may be arranged in any number of shapes. As shown in the figure, the openings 13 are aligned in a triangular shape, with two openings 13 aligned along the length of the body 10. Each opening 13 provides access to an interior space defined by the slot 11. Blade 12 can be placed within each one of these openings 13, such that a portion of the blade 12 can extend through opening 13 into the slot 11, spanning the slot 11. As such, a material passed through the slot 11 will be cut by the blade 12. Blade 12 will be positioned in one of the six openings 13 depending on a desired cutting height. However it should be understood that different numbers of openings may be used, depending on embodiment.

Figure 2:
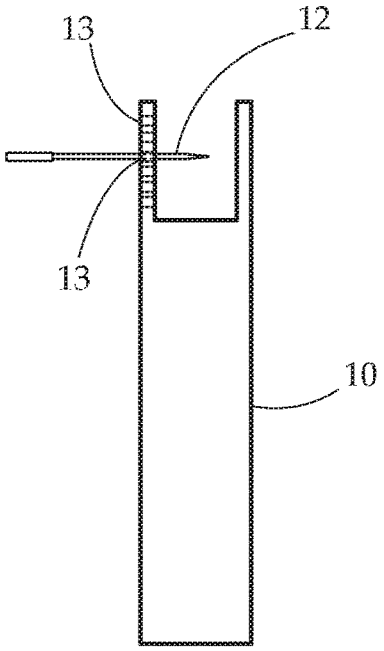
FIG. 2 provides a frontal elevation view of another embodiment of the present invention.

FIG. 2 shows another embodiment of a side view of the cutting device. In this view, an end of the body 10 is shown. The flat bottom face is shown facing upward, and the slot 11 can be seen defined along the entire length of the body 10. In this view, blade 12 can be seen passing through opening 13 and into the slot 11. As configured, any elongate strip passing through slot 11 having a protrusion that extends higher than a distance from the bottom face of the body 10 to the blade 12 will be cut, thereby providing a flat, even height of the elongate strip.

Figure 3:
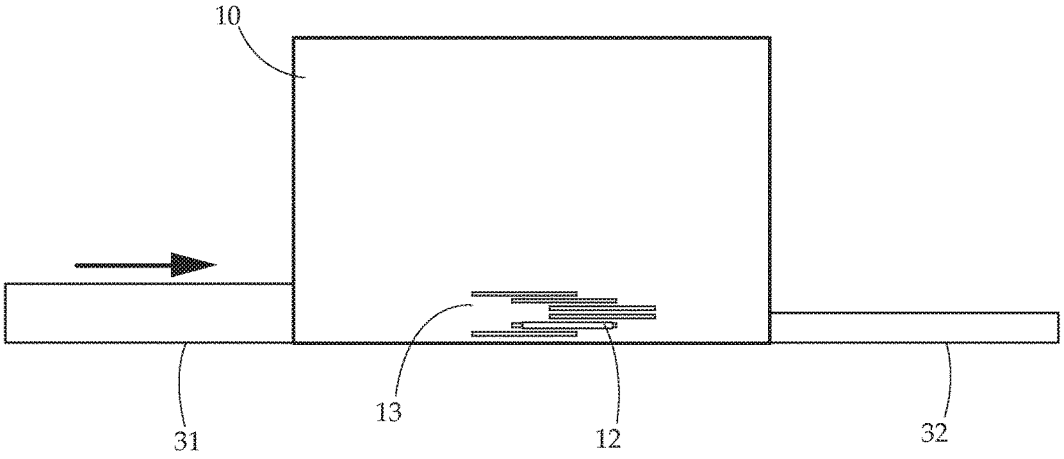
FIG. 3 provides a side view of an embodiment of the present invention in use.

FIG. 3 provides a perspective view of an embodiment of the cutting device in use cutting an elongate strip. In this view, body 10 is in an operating position having the flat bottom face facing downward (however it should be understood that the device may be used in any orientation without straying from the scope of the present invention). Body is drawn in the direction of the arrow along the plastic strip 31. Blade 12 is positioned within opening 13 at the lowest opening (corresponding to a shorter height of the cut strip). As the body 10 is drawn along the strip 31, the height of the strip is reduced to the cut level. The cut portion of the strip 32 can be seen extending from the back of the body after passing through slot 11.

Figure 4:
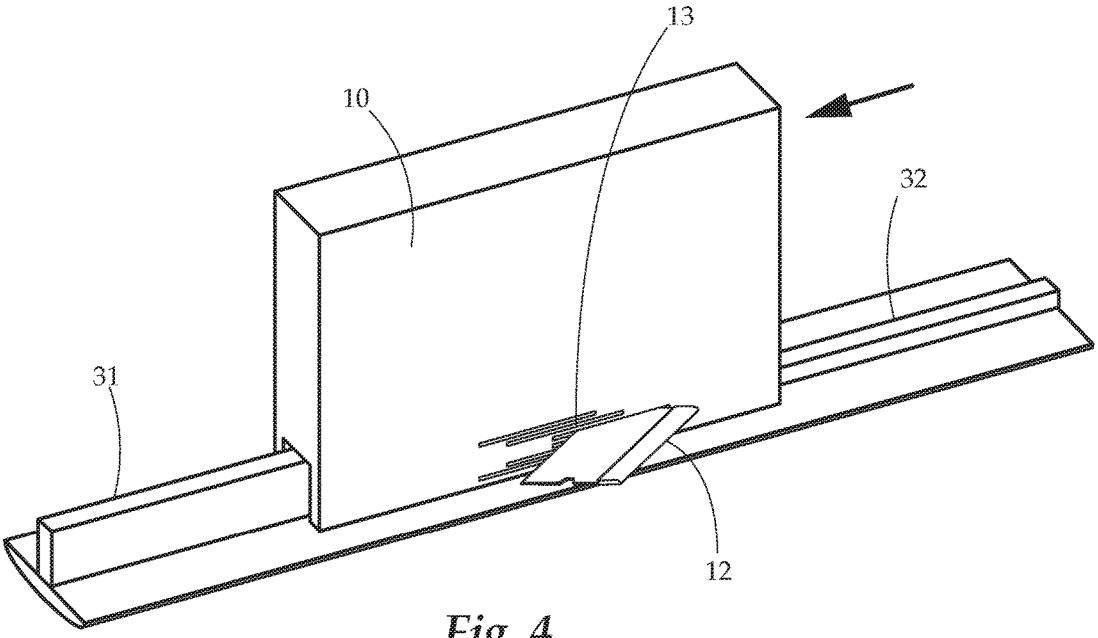
FIG. 4 provides a perspective view of another embodiment of the present invention in use.

FIG. 4 provides a side view of an embodiment of the cutting device in use cutting an elongate strip. In this view, plastic strip 31 may be drawn through slot 11 (or body 10 may be drawn over strip 31). During this drawing, blade 12 within slot 11 (not shown in this view) may cut the protrusion of the strip to the blade 12 height. Because the flat bottom of the body 10 stays on the operating surface (such as the table, floor, etc.) the blade 12 is maintained at a consistent height, thereby providing an even cut of the plastic strip 31 to the shortened cut form 32.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A method of cutting a shower door strip using a shower door strip cutting device comprising the steps of:

positioning the shower door strip into a slot of the shower door strip cutting device, the shower door strip cutting device comprising: a rectangular body;

the slot formed by the body along a length of a bottom face of the body, the slot being a depression along the length of the bottom face and extending from a front end of the body to a back end of the body;

a plurality of openings defined by an one side of the body, each of the plurality of openings providing access to the slot from the one side of the body at a different height and being bounded on an entire length of each of sides, top, and bottom, such that each of the plurality of openings is bounded by the body, wherein each opening is sized to allow at least a portion of a cutting blade to pass through the opening into the slot;

wherein the cutting blade fits at least partially within the slot; the shower door strip comprising a protrusion and at least one flange extending from at least one side of the protrusion;

wherein the step of positioning the shower door strip comprises positioning the protrusion of the shower door strip into the slot, having the at least one flange abutting the bottom face of the body;

removably positioning the cutting blade in one of the plurality of openings; urging the blade against the protrusion of the shower door strip to engage the blade with the protrusion, the urging being one of a drawing the body in a direction towards the shower door strip, and drawing the shower door strip towards the body;

cutting the protrusion by the step of urging the blade against the protrusion; and removing the body from the shower door strip after the cutting step.

2. The method of claim 1 further comprising the step of removing the blade from the opening after the cutting step.

3. The method of claim 1 wherein the bottom face is flat.

4. The method of claim 1 further comprising the step of removably positioning the cutting blade in the opening such that the blade forms an acute angle with respect to an outer face of the one side of the body.

5. The method of claim 1 wherein the shower door strip comprises two flanges.

6. The method of claim 1 wherein the slot is formed having straight sided left and right sides such that the slot defines a rectangular cross section.

* * * * *